United States Patent [19]

Kato et al.

[11] Patent Number: 4,537,352

[45] Date of Patent: Aug. 27, 1985

[54] FUEL INJECTION APPARATUS

[75] Inventors: Masaaki Kato, Toyoake; Tetsuji Akashi, Oobu, both of Japan

[73] Assignee: Nippondenso Co., Ltd., Kariya, Japan

[21] Appl. No.: 430,609

[22] Filed: Sep. 30, 1982

[30] Foreign Application Priority Data

Oct. 5, 1981 [JP] Japan ..... 56-158499
Oct. 5, 1981 [JP] Japan ..... 56-158500

[51] Int. Cl.[3] ..... F02M 47/02

[52] U.S. Cl. ..... 239/90; 123/446; 239/91; 239/93; 239/95

[58] Field of Search ..... 239/88–96, 239/570; 123/446, 500

[56] References Cited

U.S. PATENT DOCUMENTS

| | | | |
|---|---|---|---|
| 4,129,253 | 12/1978 | Bader, Jr. et al. | 239/88 |
| 4,235,374 | 11/1980 | Walter et al. | 239/90 |
| 4,273,090 | 6/1981 | Höfer et al. | 123/500 |
| 4,378,774 | 4/1983 | Kato | 239/88 |
| 4,385,609 | 5/1983 | Kato | 239/88 |
| 4,396,151 | 8/1983 | Kato et al. | 239/89 |
| 4,407,250 | 10/1983 | Eheim et al. | 123/500 |

FOREIGN PATENT DOCUMENTS 54-50726 4/1979 Japan .

*Primary Examiner*—Andres Kashnikow

*Assistant Examiner*—Kevin Patrick Weldon

*Attorney, Agent, or Firm*—Cushman, Darby & Cushman

[57] ABSTRACT

A fuel injection apparatus for an internal combustion engine having engine cylinders includes a fuel tank, fuel supply pumps and fuel injection units. Each fuel injection unit comprises a cylinder, a plunger reciprocable in the cylinder by the engine, pump chamber defined between the cylinder and the plunger and receiving fuel from the fuel supply pump, an injection nozzle communicating with the pump chamber and a timing port formed in the cylinder. The fuel injection apparatus further includes a timing passage connecting the timing port with the fuel tank and a control valve. The control valve comprises a control chamber, a control valve body movable between the open and closed positions in the control chamber for controlling fuel injection, a spring urging the control valve body towards the closed position and a timing chamber formed adjacent the control chamber in the fuel injection unit for receiving fuel to move the control valve body towards the closed position. The fuel injection apparatus further includes a fuel control pump having as many output ports as the engine cylinders. The fuel control pump is operated by the engine to pump out fuel from the fuel supply pump to the timing chamber through the corresponding output port at timing and for a period determined by operational condition of the engine.

12 Claims, 7 Drawing Figures

FUEL INJECTION APPARATUS

BACKGROUND OF THE INVENTION

This invention relates to a fuel injection apparatus for injecting fuel into an internal combustion engine, especially a diesel engine.

In a prior art fuel injection apparatus of this type, fuel under high pressure supplied from a fuel supply pump is further pressurized in a fuel injection pump chamber by a plunger reciprocated in synchronism with an engine, and is sprayed from an injection nozzle into engine cylinders.

In injecting fuel into the engine, it is necessary to control fuel injection timing and fuel injection quantity according to the operational conditions of the engine. For such control, there has conventionally been developed control means using a solenoid valve, as stated in Japanese Patent Disclosure No. 50726/79. In this control means, the fuel injection quantity and fuel injection timing are controlled in accordance with electromagnetic pulses generated from the solenoid valve according to the operational conditions of the engine. However, since high pressure from the fuel is directly applied to the solenoid valve which has limited ability to withstand pressure so the prior art fuel injection apparatus cannot be used for injection under high pressure. To cope with this, a restrictor may be formed in a passage connecting the fuel injection pump chamber and the solenoid valve to lower the fuel pressure. The use of the restrictor would, however, cause gradual reduction of fuel quantity at the end of injection. Namely, it would retard the cut-off period of injection, and require a longer injection period for injecting the required quantity of fuel.

Since the fuel injection quantity depends only on the period during which the solenoid valve is closed, that is, on the injection period, the solenoid valve must be opened and closed in a very short time. Thus, the solenoid valve requires high responsiveness as well as high machining accuracy for the prevention of variation in injection quantity. These requirements are impractical.

SUMMARY OF THE INVENTION

The object of this invention is to provide a fuel injection apparatus which readily sets the fuel injection quantity and the fuel injection timing according to the operational conditions of an engine, and provides stable and high-pressure fuel injection with improved injection cut-off.

According to this invention, there is provided a fuel injection apparatus for an internal combustion engine having engine cylinders, which comprises a fuel tank; fuel delivery means connected to the fuel tank for delivering fuel from the fuel tank; a fuel injection unit mounted on each engine cylinder, and including cylinder means, plunger means inserted in the cyliner means and reciprocated by the engine, pump chamber means defined by the cylinder means and the plunger means, an injection nozzle operatively connected to the pump chamber means for injecting fuel into a combustion chamber of the engine cylinder while fuel under pressure is supplied from the pump chamber means to the injection nozzle, and a timing port formed in the cylinder means and opening to the pump chamber means; a timing passage connecting the timing port to the fuel tank; a control valve connected to the timing passage for opening and closing the timing passage and including a control chamber, a control valve body disposed in the control chamber and movable between an open position in which the timing passage is opened and a closed position in which the timing passage is closed, whereby the fuel injection from the injection nozzle is controlled, urging means for normally urging the control valve body to be disposed in the open position, and a timing chamber formed adjacent to the control valve body in the control chamber for allowing fuel in the timing chamber to move the control valve body to the closed position against the urging means; and a fuel control pump having as many output ports as the engine cylinders connected to the fuel delivery means and operated by the engine for pumping out fuel from the delivery means through a corresponding one of the output ports to the timing chamber at a timing and for a period determined by operational conditions of the engine.

BRIEF DESCRIPTION OF THE DRAWINGS

This invention can be fully understood from the following detailed description with reference to the accompanying drawings, in which.

DETAILED DESCRIPTION OF THE PREFERRED EMBODIMENTS

Figure 1:
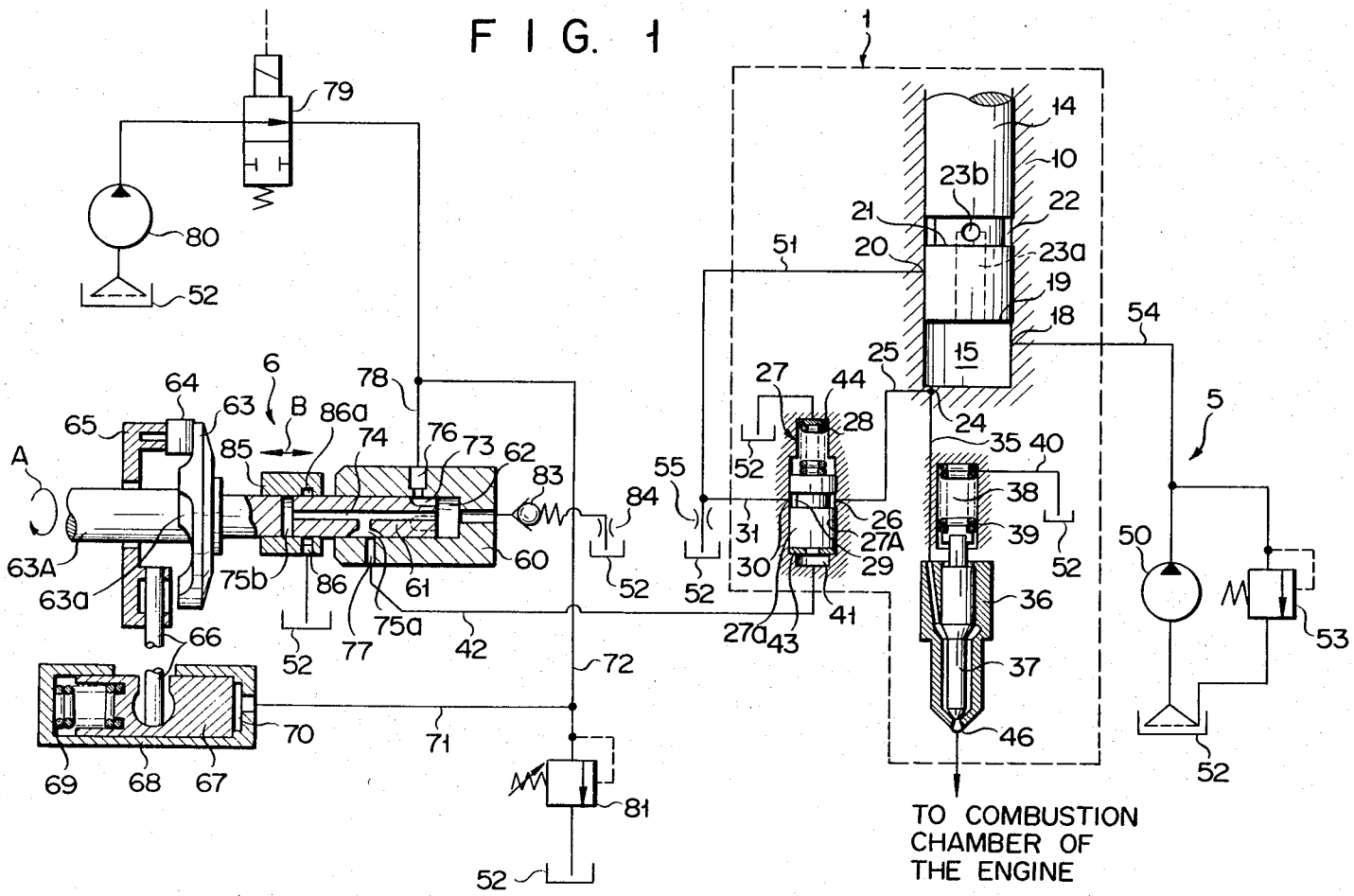
FIG. 1 is a system diagram showing one embodiment of the fuel injection apparatus of this invention.
Figure 2:
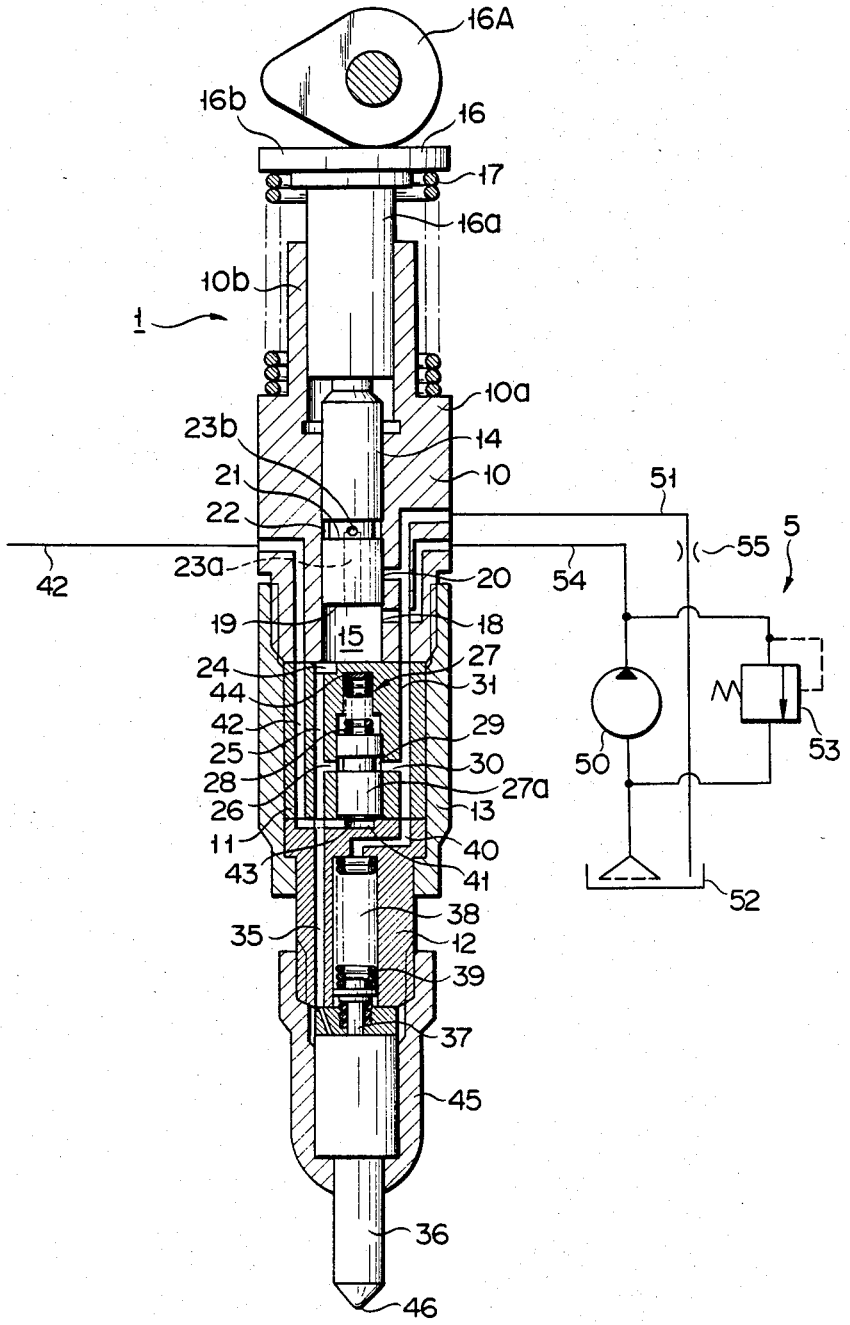
FIG. 2 is a longitudinal sectional view of a fuel injection unit of the apparatus shown in FIG. 1.

FIGS. 1 and 2 show a first embodiment of the fuel injection apparatus of this invention.

The fuel injection apparatus used for a diesel engine comprises a fuel injection unit 1 connected to a fuel supply system 5, and a control pump 6.

Referring to FIG. 2, the fuel injection unit 1 comprises a fuel injection cylinder 10 and a nozzle holder 12 fitted with a fuel control cylinder 11 coaxial with the fuel injection cylinder 10. The fuel control cylinder 11 and the nozzle holder 12 are fixedly attached to the fuel injection cylinder 10 by means of a holder nut 13.

A fuel injection plunger 14 is longitudinally and slidably inserted into the fuel injection cylinder 10 such that a pump chamber 15 is defined between the lower end of the plunger 14 and the lower cylindrical wall of the cylinder 10. The upper end of the plunger 14 abuts against the lower end of a plunger portion **16*a* of a follower 16 which is inserted into the fuel injection cylinder 10 for longitudinal reciprocation. The upper end of the follower 16 forms a disk portion 16*b* with a diameter greater than that of the plunger portion 16*a*. A shoulder 10*a* is formed at the middle portion of the fuel injection cylinder 10, and a helical compression coil spring 17 is wound around a narrowed portion 10*b* of the cylinder 10 extending above the shoulder 10*a*. The ends of the spring 17 are pressed against the shoulder 10*a* and the disk portion 16*b* of the follower 16, respectively, to normally urge the follower 16 upward in FIG. 2. The peripheral edge of a drive cam 16A rotated in synchronism with the operation of a diesel engine abuts against the disk portion 16*b* of the follower 16 to move the follower 16 up and down. The plunger 14 is provided with a metering lead 19 at the lower end for opening and closing an inlet port 18 in the cylinder 10. An annular groove 22 is formed in an intermediate portion of the lateral outer wall of the plunger 14. The lower edge of the annular groove 22 constitutes a spill lead 21 for opening and closing an outlet port 20 disposed above the inlet port 18. Formed in the plunger 14 are a vertical hole 23*a* and a horizontal hole 23*b* connecting the pump chamber 15 to the annular groove 22**.

The inlet port 18 connects with a fuel supply pump 50 of the fuel supply system 5 through a fuel supply passage 54, while the outlet port 20 communicates with a fuel reservoir 52 through a return passage 51 having a restrictor 55 on its downstream side. Fuel is sucked in by the fuel supply pump 50 rotated by the engine from the fuel reservoir 52, and the fuel pressure is adjusted to a required value by means of a pressure regulating relief valve 53. Thereafter, the fuel is delivered by the fuel supply pump 50 to the pump chamber 15 through a fuel supply passage 54 and the inlet port 18.

A timing port 24 opening to the pump chamber 15 is formed in the upper end face of the fuel control cylinder 11, and a timing passage 25 connecting at the upper end with the timing port 24 vertically penetrates the fuel control cylinder 11. Also, a drain passage 31 connecting at the upper end with the outlet port 20 and the return passage 51 penetrates the fuel control cylinder 11. A spool-type fuel control valve (or timing valve) 27 has a control valve body **27*a* which is vertically and slidably disposed in a control chamber 27A formed in the fuel control cylinder 11, and is normally urged downward by a helical compression coil spring 28 disposed above the control valve body 27*a* in the fuel control cylinder 11. A fuel control port 26 and a drain port 30 are formed on the same level in the fuel control cylinder 11. The port 26 communicates with the timing passage 25, while the port 30 communicates with the return passage 51 by means of the drain passage 31. An annular groove 29 is formed in the outer periphery of an intermediate portion of the fuel control valve body 27*a*, whereby the ports 26 and 30 are connected or disconnected according to the vertical position or displacement of the valve body 27*a***, as mentioned later.

The timing port 24 communicates with an injection nozzle 36 through a delivery passage 35. The injection nozzle 36 is of a conventional type in which a nozzle hole 46 is opened and closed by a needle valve 37. The injection nozzle 36 is attached to the nozzle holder 12 by means of a retaining nut 45. The needle valve 37 is urged downward by a nozzle spring 39 housed in a nozzle spring chamber 38 which is defined in the nozzle holder 12. The nozzle spring chamber 38 communicates with the return passage 51 through a leak passage 40 which is formed in the nozzle holder 12 and connects at both ends with the drain passage 31 and the nozzle spring chamber 38. A pressure intake chamber or timing chamber 41 is formed in the upper end face of the nozzle holder 12 so as to open to the control cylinder 11 and communicate with a control passage 42 formed in the control cylinder 11. If a fuel pressure above a predetermined pressure level is applied to the control valve 27 through the control passage 42 and the chamber 41, the control valve body **27*a* is moved upward against the spring 28, thereby disconnecting the annular groove 29 from the control port 26 and the drain port 30. Shims 43 and 44 at both ends of the control valve 27 adjust the stroke of the control valve body 27*a* and the set pressure of the spring 28**, respectively.

As shown in FIG. 1, the control passage 42 is connected to the control pump 6. In this embodiment, the control pump 6 is a distribution type pump which is provided with a distributing cylinder 60 and a distributing plunger 61 inserted into the cylinder 60. A distributing pump chamber 62 is defined between the inner wall face of the distributing cylinder 60 and the inner end of the distributing plunger 61 in the distributing cylinder 60.

A face cam 63 is coaxially fixed to the outer end of the distributing plunger 61. The distributing plunger 61 and the face cam 63 are rotated by the engine by way of a shaft 63A. Formed on the opposite surface of the face cam 63 to the distributing plunger 61 are as many cam surfaces **63*a* as engine cylinders. Cam surfaces 63*a* are in contact with cam rollers 64. The cam rollers 64 are rotatably held in a roller holder 65 which swings around the plunger 61. The roller holder 65 is coupled with a timer lever 66 protruding radially outward therefrom. The timer lever 66 is coupled to a timer piston 67 of a timer piston-cylinder assembly 67–68. The timer piston 67 is longitudinally and slidably inserted into a timer cylinder 68, and is normally urged in one direction by a helical compression coil spring 69. The opposite end of the timer piston 67 to the spring 69 and the inner wall surface of the timer cylinder 68 define an operation chamber 70, which communicates with a pressure regulating passage 72 (mentioned later) through a timer passage 71. In the actual arrangement, the timer cylinder 68 and the timer piston 67 should be rotated through 90° around the timer lever 66 from the position shown in FIG. 1 so that the axis of the timer cylinder 68 is at right angles to the plane of FIG. 1. If the timer piston 67 is moved toward the spring 69, the roller holder 65, along with the rollers 64, is rocked in the direction indicated by an arrow A in FIG. 1 by the timer lever 66**.

The distributing plunger 61 comprises feed ports 73 formed at the inner end portion thereof, a communication passage 74 extending coaxially with the central axis of the plunger 61 and opening into the chamber 62, a first discharge port **75*a* extending perpendicularly from an intermediate portion of the communication passage 74 up to the outer surface of the distributing plunger 61, and a second discharge port 75*b* penetrating the distributing plunger 61 at right angles to the communication passage 74 for communication with the passage 74 at its blind end. The feed ports 73 are as many as the engine cylinders, and are arranged at regular intervals along the circumference of the distributing plunger 61. Formed in the distributing cylinder 60 are an inlet port 76 and outlet ports 77, and one of the outlet ports 77 is allowed to be connected with the first discharge port 75*a* in accordance with the rotational and reciprocal movements of the plunger 61. The outlet ports 77 are as many as the engine cylinders, and are arranged at regular intervals along the circumference of the distributing cylinder 60. Thus, the outlet ports 77 communicate with the control passages 42 of their corresponding cylinders. The inlet port 76 communicates through a supply passage 78 and a cut-off solenoid valve 79 with a fuel supply pump 80 which is connected to the fuel reservoir 52. The cut-off solenoid valve 79** closes the supply passage 78 when the engine is stopped. The pressure regulating passage 72 is branched from the supply passage 78. A pressure regulating valve 81 is provided in it. The distributing pump chamber 62 connects with the fuel reservoir 52 through a relief valve 83 and a restrictor 84. The discharge port 75*b* of the plunger 61 can be aligned with an annular groove 86*a* formed in the inner wall surface of a spill ring 85 which surrounds the plunger 61 so that the discharge port 75*b* communicates with the fuel reservoir 52 through an outlet port 86 which extends from the annular groove 86*a* to the outer peripheral surface of the ring 85.

When the engine is in operation, fuel from the fuel supply pump 50 whose maximum pressure is adjusted by the relief valve 53 is delivered into the fuel injection pump chamber 15 in the fuel injection cylinder 10 through the fuel supply passage 54. When the plunger 14 of the fuel injection unit 1 is pressed by the drive cam 16A and lowered from its top dead point, the fuel in the pump chamber 15 is pressurized. When the control valve body 27*a* is held at its bottom dead point by the urging force of the spring 28, the control port 26 and the drain port 30 are connected through the annular groove 29. Thus, the fuel under pressure in the fuel injection pump chamber 15 is delivered into the fuel reservoir 52 via the timing port 24, timing passage 25, control port 26, annular groove 29, drain port 30, and drain passage 31.

Also when the plunger 14 is lowered to such a position that the timing lead 19 closes the inlet port 18, the fuel in the pump chamber 15 is discharged into the fuel reservoir 52 still following the aforesaid course.

The pressure of fuel supplied from the fuel supply pump 80 is adjusted by the regulating valve 81 so that a pressure corresponding to the operational condition of the engine is produced in the operating chamber 70 of the timer cylinder 68. The timer piston 67 is moved to the position where the urging force of the spring 69 corresponds to the pressure in the operating chamber 70. Then, the roller holder 65, as well as the cam rollers 64, is rocked in the direction indicated by the arrow A through an angle corresponding to the displacement of the timer piston 67 by means of the timer lever 66 so that the injection timing may be changed in accordance with the operational conditions of the engine. When the shaft 63A is rotated by the engine, the distributing plunger 61 is moved rightwardly from the position of FIG. 1 in which the inlet port 76 connects with the feed port 73 to a position in which the ports 76 and 73 are disconnected. After the disconnection of the ports 73 and 76, the face cam 63 moves the distributing plunger 61 further in the rightward direction while rotating the same, thereby raising the fuel pressure inside the distributing pump chamber 62. The fuel under high pressure is supplied through the communication passage 74, discharge port 75*a* and the control passage 42 to the port 41 to increase the pressure in it. As a result, the control valve body 27*a* is raised against the urging force of the spring 28. Thus, the annular groove 29 of the control valve 27 is moved to the region outside the drain port 30 to disconnect the ports 26 and 30. In consequence, the fuel under pressure in the fuel injection pump chamber 15 is prevented from escaping to the fuel reservoir 52 via the control valve 27, and is fed to the injection nozzle 36 through the delivery passage 35 to force the needle valve 37 to open. Thus, the fuel is injected from the nozzle hole 46 into the corresponding engine cylinder.

As the face cam 63 moves to the right in synchronism with additional lowering of the plunger 14, the distributing plunger 61 of the distributing pump 6 is moved to the right until the outlet port 86 of the spill ring 85 connects with the discharge port 75*b*. The connection of the ports 86 and 75*b* lowers the fuel pressure inside the distributing pump chamber 62. Also, fuel pressure at the port 41 is allowed to escape to the outlet port 86 via the control passage 42, outlet port 77, communication passage 74, and discharge port 75*b*. Thus, the pressure at the port 41 is reduced, and the control valve body 27*a* is lowered by the spring 28. Since the annular groove 29 connects the control port 26 and the drain port 30, fuel under high-pressure in the pump chamber 15 is discharged into the fuel reservoir 52 through the control valve 27, and the pressure inside the delivery passage 35 is lowered to stop the fuel injection from the injection nozzle 36. The spill ring 85 is moved in either direction (arrow B) according to the engine speed and the depth of depression of accelerator to determine the end of fuel injection from the nozzle hole 46.

When the plunger 14 is further lowered, the spill lead 21 comes below the outlet port 20 to allow the same to connect with the annular groove 22. Accordingly, the fuel in the pump chamber 15 is discharged from the outlet port 20 through the vertical and horizontal holes 23*a* and 23*b*, the annular groove 22 and the return passage 51 to the fuel reservoir 52. Then, the plunger 14 reaches and stops at its bottom dead point. The spill lead 21 is so located that the maximum injection quantity can be maintained.

The drive cam 16A is further rotated to raise the plunger 14. When the metering lead 19 rises above the inlet port 18 to allow it to connect with the pump chamber 15, fuel is fed from the fuel supply system 5 into the pump chamber 15 for the next descending stroke of the plunger 14.

The relief valve 83 opens to lower the pressure inside the distributing pump chamber 62 when it increases unduly above the necessary pressure to drive the control valve 27. The restrictor 84 prevents the pressure from suddenly dropping when the relief valve 83 is opened.

Thus, in the fuel injection apparatus according to the embodiment shown in FIGS. 1 and 2, the fuel injection timing depends on the timing for the drive of the control valve 27, and the fuel injection quantity depends on the period of time when the control valve 27 is actuated, that is, the period when the ports 26 and 30 are being disconnected by the control valve body 27*a*. Since the control valve 27 is driven by the control pump 6, the injection timing and injection period are set by controlling the control pump 6. More specifically, as is the case with the distributing pump, the starting timing of the fuel injection is controlled by the timing at which the feed port 73 and the inlet port 76 are disconnected. The injection quantity depends on the time interval from the time at which the feed port 73 is disconnected from the inlet port 76 to the time at which the discharge port 75*b* connects with the outlet port 86. In the control pump 6, the distributing plunger 61 and the face cam 63 rotate and reciprocate in accordance with the engine speed. Thus, the injection quantity can be obtained according to the engine speed, etc. By controlling the pressure regulating valve 81, the displacement of the timer plunger 67 can be adjusted, to set the angle of lead or delay of the face cam 63, whereby the injection timing can be controlled.

Moreover, the control valve 27 is housed in the control cylinder 11, and the flow of fuel passing through the valve 27 can be started or stopped by connecting or disconnecting the ports 26 and 30. Thus, the resisting pressure of the control valve 27 is high, and the return of the valve body 27*a* at the end of the injection can be quickly made to ensure high-accuracy in injection cut-off.

Figure 3:
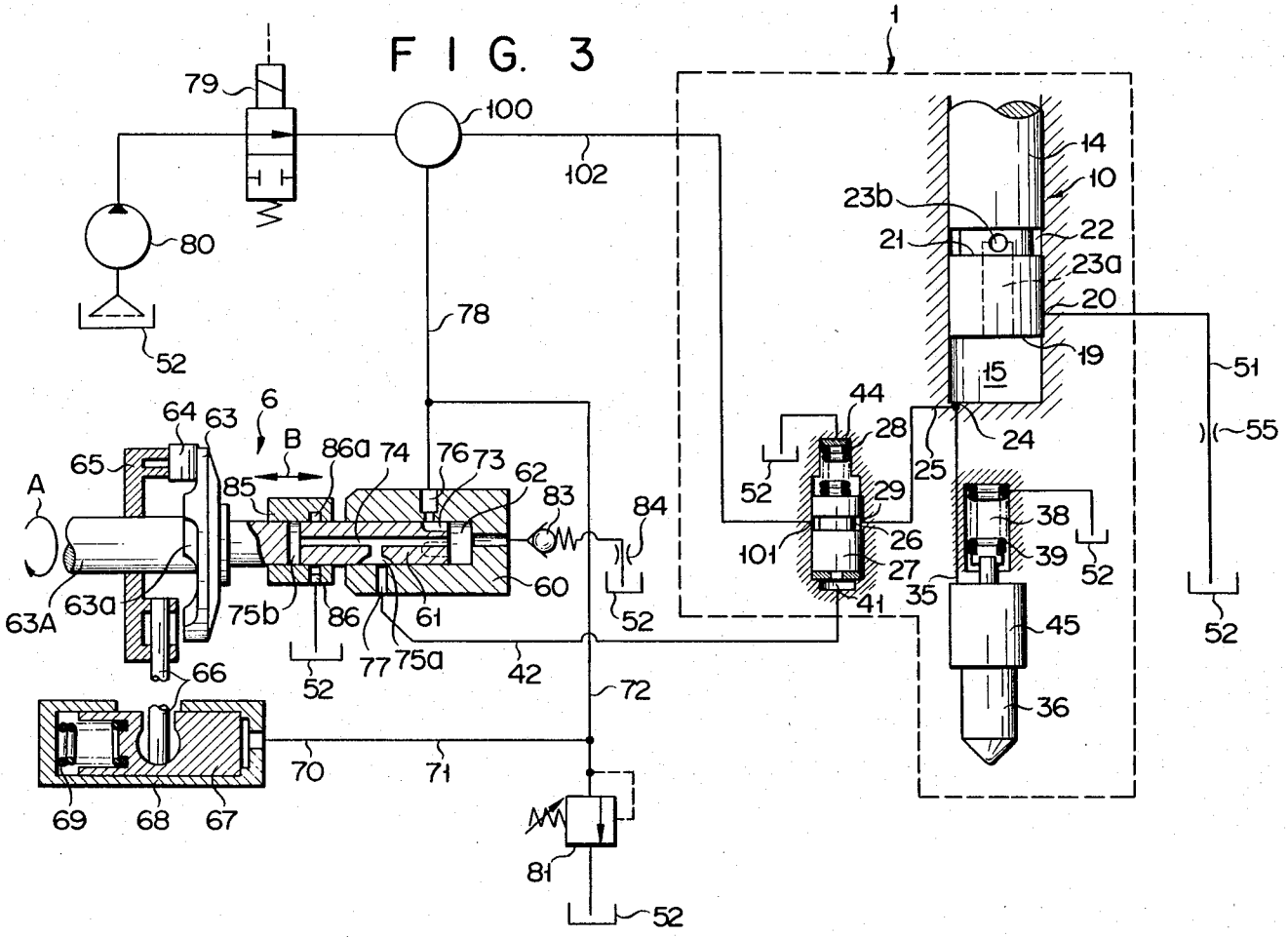
FIG. 3 is a system diagram showing another embodiment of the invention.

The apparatus of this invention may also be constructed as shown in FIG. 3. The modification shown in FIG. 3 differs from the embodiment shown in FIGS. 1 and 2 in that the one fuel supply pump 50 is omitted, and that a surge tank 100 is disposed in a supply passage 78 connecting a cut-off solenoid valve 79 of the other fuel supply pump 80 and an inlet port 76 of a control pump 6. Moreover, the drain port 30 of the control valve 27 is replaced with a feed port 101 which connects with the surge tank 100 through a passage 102. Other portions or components are constructed in the same manner as those included in the embodiment of FIGS. 1 and 2, and the detailed description of those components will not be repeated.

According to this construction, fuel is supplied to the fuel injection pump chamber 15 when the pump 80 connects with the chamber 15 through the surge tank 100, the feed port 101 of the control valve 27, an annular groove 29, a control port 26, a control passage 25, and a timing port 24.

The control pump 6 is not limited to the aforementioned distributing pump, and may alternatively be an in-line pump.

Figure 4:
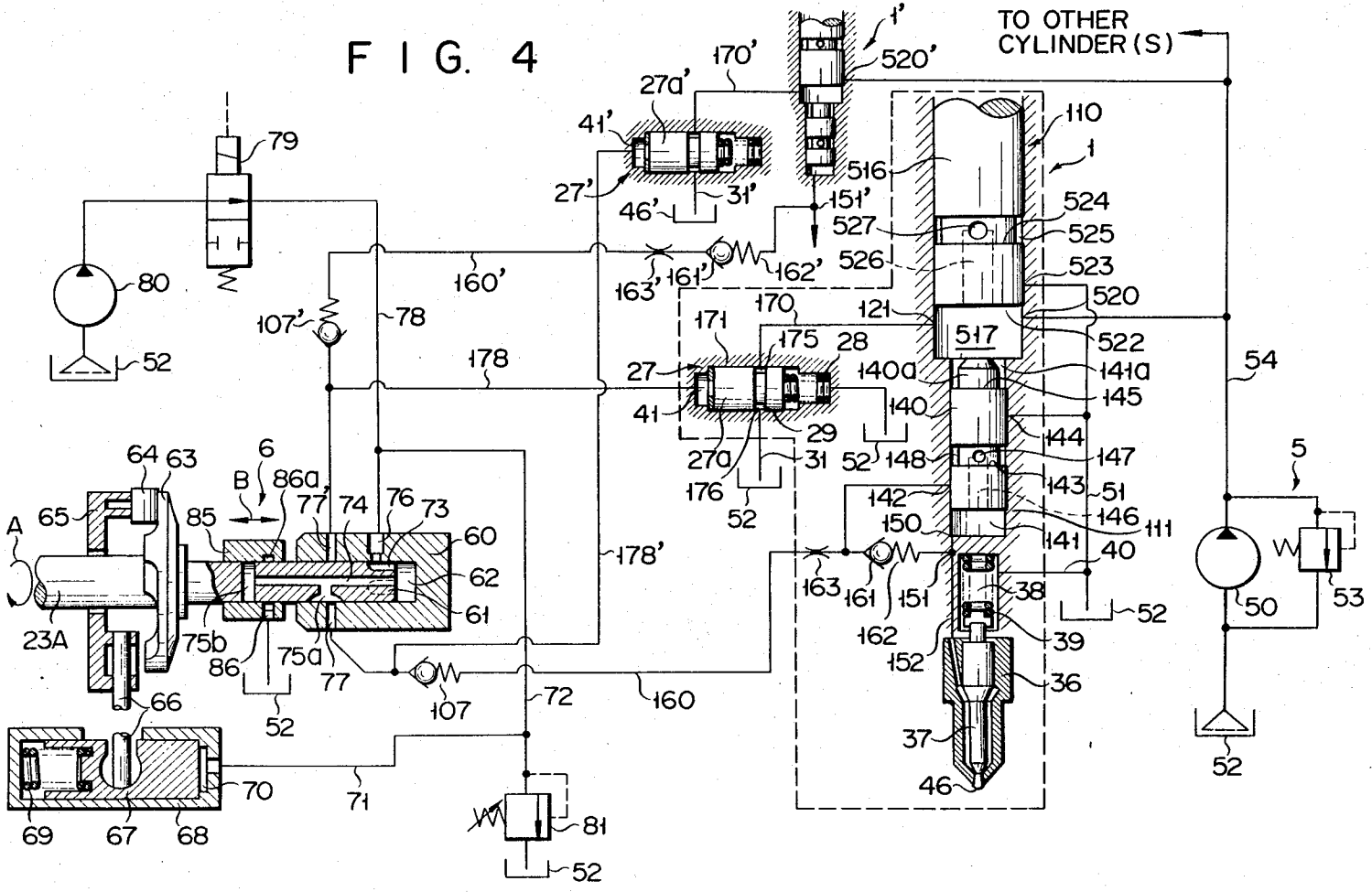
FIG. 4 is a system diagram showing still another embodiment of the invention.
Figure 5:
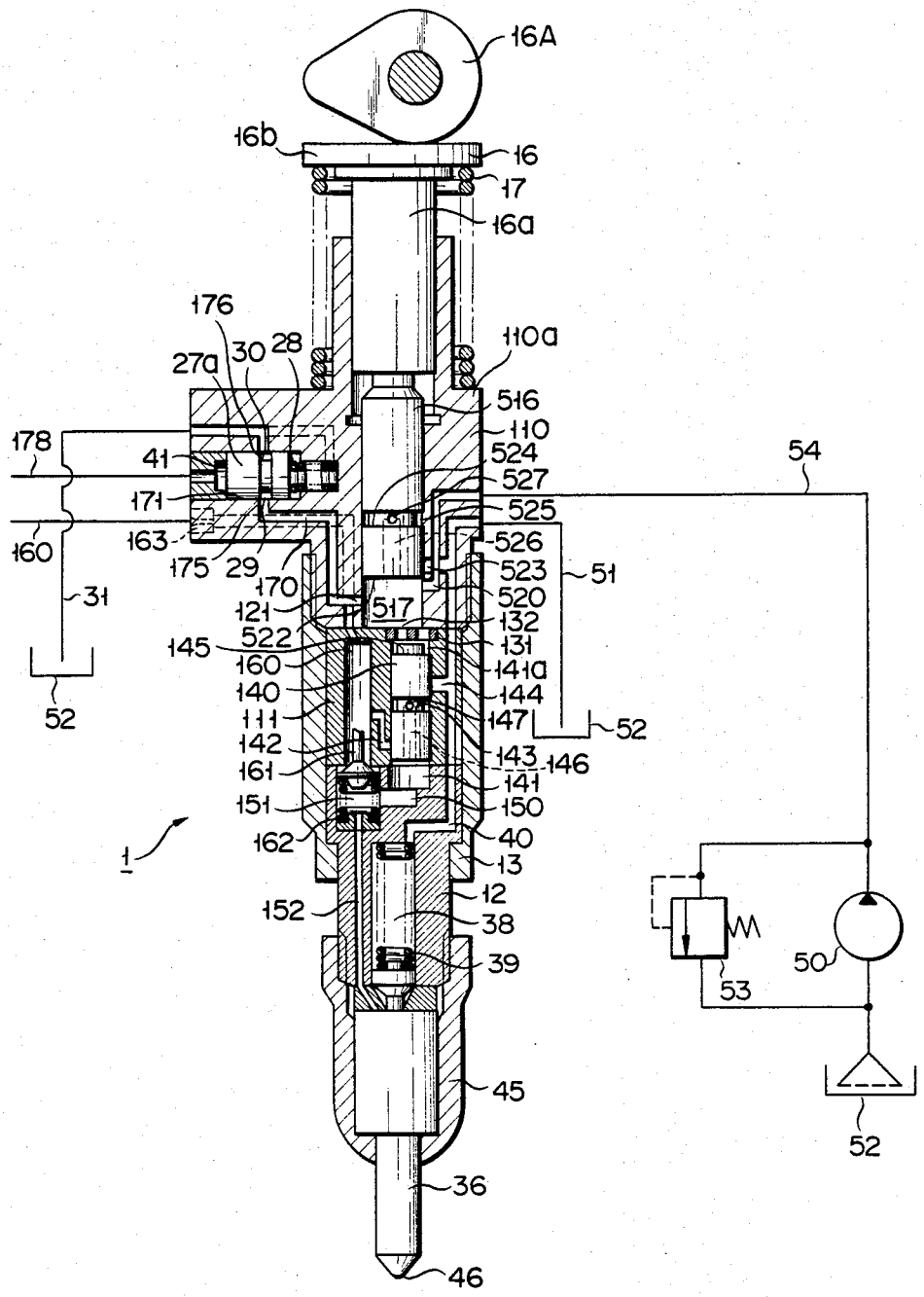
FIG. 5 is a longitudinal sectional view of a fuel injection unit of the apparatus shown in FIG. 4.

FIGS. 4 and 5 show a third embodiment of the invention. In the description to follow, like reference numerals are used to designate the same portions as shown in FIGS. 1 and 2.

A fuel injection unit 1 comprises a fuel delivery cylinder 110 having substantially the same construction as that of the fuel injection cylinder 10 of the embodiment shown in FIGS. 1 and 2, a fuel injection cylinder 111 coaxially disposed under the cylinder 110 and a nozzle holder 12 coaxially fixed to the cylinder 111 and an injection nozzle 36 coaxially disposed under nozzle holder 12 by means of a retaining nut 45. The cylinder 111 and the holer 12 is connected to the cylinder 111 by a holder nut 13.

The fuel delivery cylinder 110 has a timing port 121 which opens into the interior of the cylinder 110 at a position below an inlet port 520 in the cylinder 110. The timing port 121 is opened and closed by a metering lead 522 as a fuel delivery plunger 516 corresponding to the plunger 14 of FIGS. 1 and 2 ascends and descends.

In FIGS. 4 and 5, a shoulder 110*a*, the plunger 516, a delivery pump chamber 517, the inlet port 520, the metering lead 522, an outlet port 523, a spill lead 524, an annular groove 525, a vertical hole 526, and a horizontal hole 527 correspond to the shoulder 10*a*, plunger 14, pump chamber 15, inlet port 18, metering lead 19, spill lead 21, annular groove 22, vertical hole 23*a*, and horizontal hole 23*b*, respectively, of the embodiment shown in FIGS. 1 and 2.

A fuel injection plunger 140 is slidably inserted in the injection cylinder 111. The upper end of the injection cylinder 111 connects with the delivery chamber 517 through communication holes 132 formed in a stop 131 disposed in the cylinder 111 at the upper end portion thereof. Thus, the injection plunger 140 is pushed downward by the fuel pressure in the delivery pump chamber 517. The inner diameter of the injection cylinder 111 is smaller than that of the delivery cylinder 516. The inner surface of the upper end portion of the injection cylinder 111 and the upper end of the fuel injection plunger 140 define a pressure receiving chamber 141*a* which communicates with the delivery pump chamber 517 through the communication holes 132. The inner surface of the lower end portion of the injection cylinder 111 and the lower end of the fuel injection plunger 140 define an injection pump chamber 141. Formed in an intermediate portion of the outer peripheral surface of the fuel injection plunger 140 is an annular groove 148 which communicates with the injection pump chamber 141 through vertical hole 146 and a horizontal hole 147. As the fuel injection plunger 140 moves vertically, a spill lead 143 defined by the lower edge of the annular groove 148 closes and opens a spill port or metering port 142 formed in the injection cylinder 111. A drain lead 145 defined by the stepped portion between a narrowed portion 140*a* at the upper end portion of the fuel injection plunger 140 and the body of the plunger 140 closes and opens a drain port 144 formed at that portion of the injection cylinder 111 which is nearer to the pump chamber 517 than the annular groove 148 is, as the drain lead 145 moves vertically. The spill port 142 is connected to a metering passage 160 (mentioned later), while the drain port 144 connects with a return passage 51.

The injection pump chamber 141 communicates with a metering valve spring chamber 151 in the nozzle holder 12 through a metering port 150 at the lower end of the pump chamber 141. The metering valve spring chamber 151 connects with the injection nozzle 36 through a delivery passage 152.

The metering valve spring chamber 151 connects with the metering passage 160 through a metering valve 161. The metering valve 161 is a check valve which is urged by a metering valve spring 162 to allow fuel to flow only toward the injection pump chamber 141. The metering passage 160 connects with a distributing control pump 6 through a restrictor 163.

The timing port 121 of the delivery pump chamber 517 is connected to a timing valve chamber 171 as a fuel injection timing control mechanism 27 through a timing passage 170. The timing valve chamber 171 is formed in the wall of the delivery cylinder 110, and a timing valve body 27*a* is slidably inserted in the timing valve chamber 171. An annular groove 29 connects and disconnects a spill port 175 opening to the timing valve chamber 171 and a drain port 176 in alignment with the spill port 175, in accordance with the action of the timing valve body 27*a*. The spill port 175 connects with the timing passage 170, while the drain port 176 communicates with a fuel reservoir 52 through a drain passage 31. The timing valve body 27*a* is moved against a timing spring 28 by the pressure of fuel led into a pressure intake chamber 41.

The distributing apparatus 6 differs from the one shown in FIG. 1 only in that it is not provided with the relief valve 83 shown in FIG. 1.

An outlet port 77 is connected to the metering passage 160 through a metering check valve 107. Another outlet port 77' located directly ahead of the port 77 as viewed along the rotating direction of the distributing plunger 61 connects with the pressure intake chamber 41 by means of a passage 178. Although shown as being diametrically opposed to the port 77 in FIG. 4, the port 77' may be located in any other position depending on the number of cylinders.

The port 77 is connected to the metering valve spring chamber 151 of the fuel injection unit 1 through the check valve 107, the restrictor 163 and the check valve 161 with the spring 162 arranged in the passage 160.

A pressure passage 178' of the next engine cylinder branched from the portion of the metering passage 160 which is on the upstream side of the metering check valve 107. The pressure passage 178' connects with a pressure intake chamber 141' of a valve 27' for the next cylinder. A metering passage 160' for the next engine cylinder is branched from the pressure passage 178, and leads to a subsequent metering valve spring chamber 151' through a metering check valve 107', a restrictor 163', and a metering valve 161'. The timing valve chamber 171', valve body 27'a, pressure intake chamber 141', metering check valve 107', restrictor 163', metering valve 161', and metering valve spring chamber 151' have the same construction and operate in the same manner as the timing valve chamber 171, valve body 27a, pressure intake chamber 141, metering check valve 107, restrictor 163, metering valve 161, and metering valve spring chamber 151, respectively. Also, a fuel injection unit 1' for the next engine cylinder connected to the valve 27' by a timing passage 170' has just the same construction as the fuel injection unit 1. An inlet port 520' of the fuel injection unit 1' is connected to the fuel supply passage 54.

Although a fuel injection system for the two specific adjacent cylinders has been described above, the same system can be used between any adjacent cylinders.

In operation, the injection pump chamber 141 is filled with a predetermined quantity of fuel corresponding to the injection quantity in the manner mentioned later. Then, the injection plunger 140 rises to and stops at a position corresponding to the injection quantity.

The delivery plunger 516 is lowered from its top dead center by the drive cam 16A. In the timing valve 27 which is the injection timing control means, the spill port 175 is caused by the urging force of a timing spring 28 to communicate with the drain port 176 through the annular groove 29. Further, the delivery pump chamber 517 is full of fuel delivered from a fuel supply pump 50 through the fuel supply passage 54 and the inlet port 520.

As the delivery plunger 516 is lowered, the fuel in the delivery pump chamber 517 is first discharged through the inlet port 520 and the timing port 121. Then, after the inlet port 520 is closed by the metering lead 522, the fuel is discharged only through the timing port 121.

If the distributing pump 6 is operated to feed fuel under high pressure into the pressure intake chamber 41 of the timing valve 27 so that optimum injection timing can be obtained as described in connection with the embodiment of FIGS. 1 and 2, then the timing valve body 27a is moved against the timing spring 28. Accordingly, the spill port 175 is disconnected from the drain port 176, thereby preventing fuel flowing out of the delivery pump chamber 517 through the timing port 121 of the delivery pump chamber 517. As a result, the pressure of the fuel in the delivery pump chamber 517 is raised, and then delivered into the pressure receiving chamber 141a through the communication holes 132 of the injection plunger stop 131 to act on the injection plunger 140. Then, the injection plunger 140 is lowered at a speed increased by an increment corresponding to the ratio between the pressure receiving areas of the delivery plunger 516 and the injection plunger 140. Thus, the fuel in the injection pump chamber 141 is raised to a high pressure. The pressuirezed fuel is delivered to the injection nozzle 36 through the pressure regulating valve spring chamber 151 and the delivery passage 152, and is injected into the engine cylinder through the nozzle hole 46, as described in connection with the embodiment of FIGS. 1 and 2.

As the delivery plunger 516 is lowered to continue injection, the injection plunger 140 is also lowered. Then, the spill lead 143 opens the spill port 142, so that the high-pressure fuel in the injection pump chamber 141 is discharged into the metering passage 160 through the holes 146 and 147, the annular groove 148, and the spill port 142. Accordingly, the fuel pressure in the injection pump chamber 141 becomes low and the fuel injection from the nozzel hole 46 of the injection nozzle 36 is stopped.

The delivery plunger 516, together with the injection plunger 140 is further lowered, and the drain lead 145 of the injection plunger 140 opens the drain port 144. Then, the high-pressure fuel in the delivery pump chamber 517 is discharged into the fuel reservoir 52 through the drain port 144 and the return passage 51. At this time, the lowering of the injectiong plunger 140 is stopped.

The delivery plunger 516 is further lowered through a short distance, and the spill lead 524 opens the outlet port 523 so that the fuel in the delivery pump chamber 517 is returned to the fuel reservoir 52 through the holes 526 and 527, the annular groove 525, and the return passage 51. Then, the delivery plunger 516 is further lowered to reach its bottom dead center.

The fuel returned from the spill port 142 of the injection cylinder 111 to the metering passage 160 is delivered to the injection pump chamber 141 through the metering valve 161 for the next fuel delivery. Thus, the metering efficiency is improved.

When the delivery plunger 516 starts to elevate, the fuel pressure in the delivery pump chamber 517 ceases to act on the injection plunger 140, and metered fuel is supplied into the injection pump chamber 141 by the distributing control pump 6 shown in FIG. 4.

In the same manner as described with reference to FIGS. 1 and 2, a fuel supply pump 80 applies fuel pressure controlled according to the engine speed, load, etc., to an inlet port 76 and a timer pump chamber 70. A timer piston 67 operates in the same manner as the counterpart shown in FIGS. 1 and 2 in accordance with the fuel pressure in the timer pump chamber 70. Thus, the timing at which the inlet port 76 connects with, and disconnects from the feed port 73 and the timing at which a discharge port 75a connects with the outlet ports 77 and 77' are adjusted. In the state shown in FIG. 4, the inlet port 76 communicates with the feed port 73 to allow fuel under pressure to be supplied from the pump 80 to a distributing pump chamber 62. In this state, when a face cam 63 is rotated by a shaft 63A driven by the engine, the distributing plunger 61 moves to the right while rotating, thereby disconnecting the inlet port 76 from the feed ports 73. The distributing plunger 61 moves further to the right to pressurize the fuel in the distributing pump chamber 62. The pressurized fuel is delivered to the outlet port 77 or 77' through a communication passage 74 and the discharge port 75a according to a rotation angle of the distributing plunger 61. The pressurized fuel is delivered to the metering passage 160 through the outlet port 77. In the metering passage 160, the pressurized fuel forces the metering valve 161 to open after passing through the metering check valve 107, and is delivered to the injection pump chamber 141 through the metering port 150.

When the discharge port 75*a* connects with the outlet port 77' according to another rotation angle of the distributing plunger 61, the pressurized fuel in the distributing pump chamber 62 is delivered to the pressure intake chamber 41 through the communication passage 74, discharge port 75*a*, outlet port 77', and pressure passage 178. Thus, the timing valve 27 is operated in the aforementioned manner to disconnect the port 175 from the port 176.

When a discharge port 75*b* connects with the outlet port 86 of the spill ring 85, the fuel supply from the outlet port 77 or 77' is stopped.

The fuel fed into the injection pump chamber 141 is metered by shifting the position of a spill ring 85 in the directions indicated by the arrow B. Thus, as in the embodiment shown in FIGS. 1 and 2, the quantity of the fuel supplied to the injection pump chamber 141 can be determined due to the stroke of the distributing plunger 61 starting at the point where the inlet port 76 and the feed ports 73 are closed and ending at the point where the discharge port 75*b* connects with the spill port 86.

The timing for the operation of the timing valve 27 is set according to the timing for the communication between the discharge port 75*a* and the outlet port 77'.

The pressure passage 178' and the metering passage 160' of the next cylinder are branched from the metering passage 160 and the pressure passage 178, respectively, for both the metering for one engine cylinder and the setting of the injection timing for the next engine cylinder. Namely, the metering passage 160 is used to feed metered fuel to the injection pump chamber 141 of the one engine cylinder in the aforementioned manner, and the pressure passage 178' branched from the metering passage 160 is used to drive the timing valve 27' of the next engine cylinder. At the moment when the discharge port 75*b* connects with the spill port 86, the metering for the one engine cylinder ends and the returning process of the timing valve 27' for the next engine cylinder finishes.

When the delivery plunger 516 is further raised to cause the metering lead 522 to open the inlet port 520, fuel is delivered from the fuel pump 50 into the delivery pump chamber 517 to fill it. Then, the delivery plunger 516 is raised additionally and stops at its top dead center. Thereafter, the delivery plunger 516 is lowered again repeating the aforementioned processes of operation.

The open position of the timing port 121 is sufficiently lower than the inlet port 520 to delay the injection timing to the maximum. Thus, if the timing valve 27 which is the injection timing control means, malfunctions whereby, the ports 175 and 176 will be left connected to each other, fuel can be injected from the nozzle hole 46.

Figure 6:
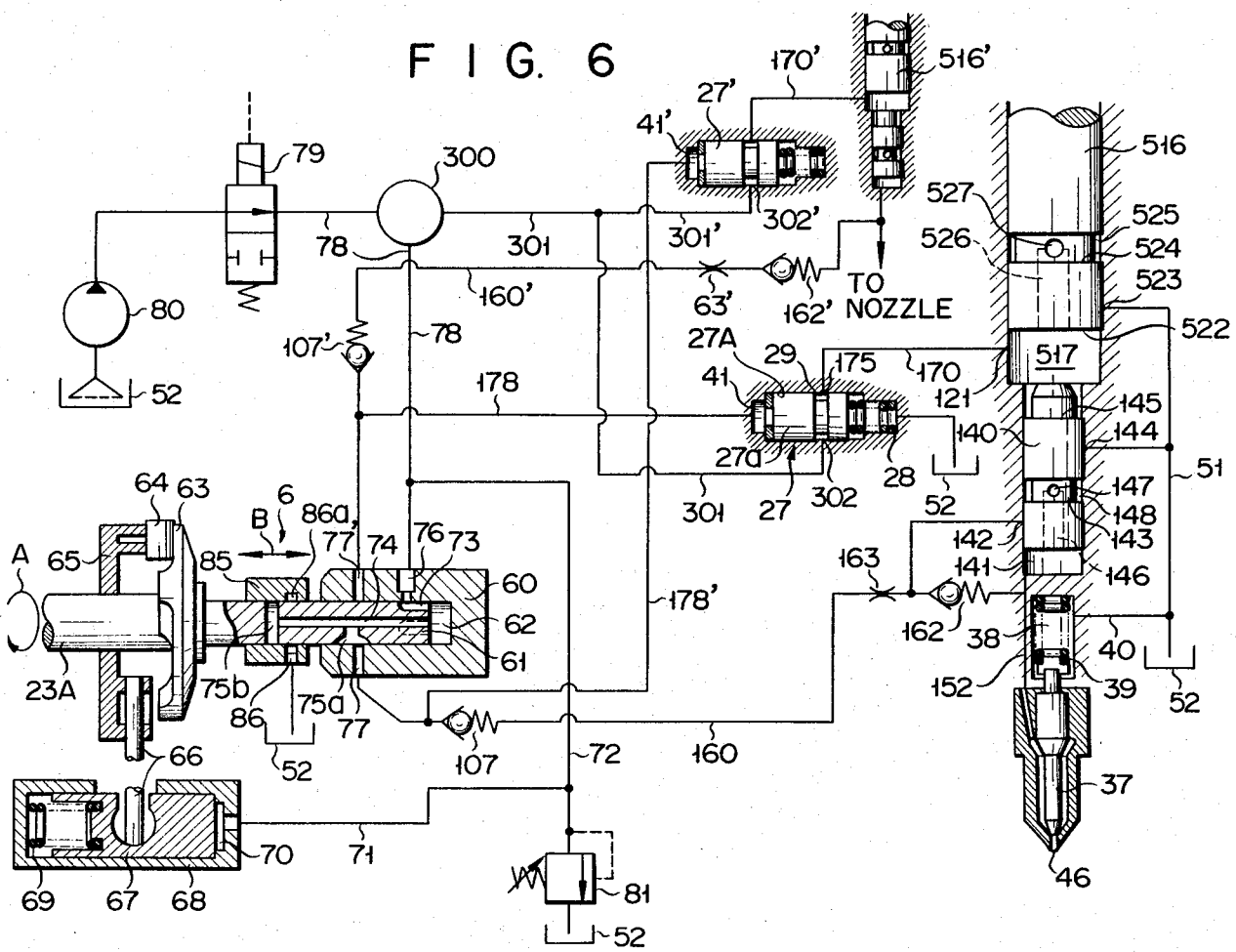
FIG. 6 is a system diagram showing a further embodiment of the invention.

Referring now to FIG. 6, there will be described the fourth embodiment of this invention. Although the two fuel supply pumps 50 and 80 are used in the third embodiment shown in FIGS. 4 and 5, only a single pump 80 is used in the fourth embodiment of FIG. 6. A surge tank 300 is provided in a supply passage 78, communicating with an inlet port 302 in a timing valve 27 through a feed passage 301 connected to the surge tank 300 and the inlet port 302. The inlet port 302 corresponds to the drain port 176 in the embodiment shown in FIGS. 4 and 5.

While a plunger 516 is ascending, pressurized fuel from the pump 80 is delivered into a delivery pump chamber 517 through the surge tank 300, feed passage 301, inlet port 302, annular groove 29, spill port 175, timing passage 170 and timing port 121.

Figure 7:
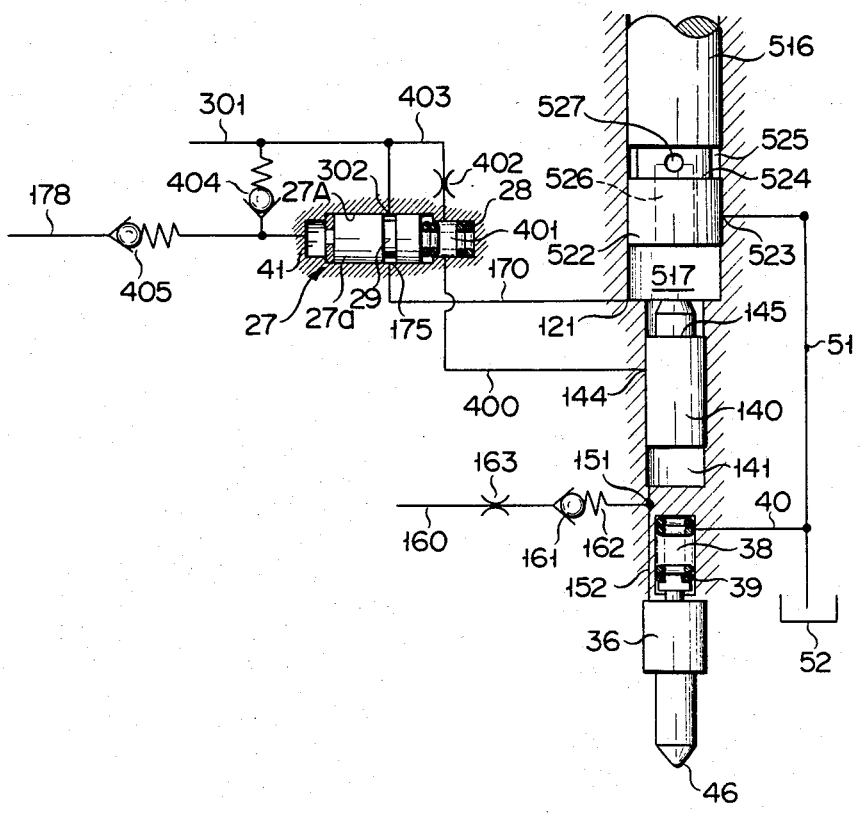
FIG. 7 shows the main part of a still further embodiment of the invention.

This invention may also be embodied in an apparatus with a principal part as shown in FIG. 7..This embodiment has the same construction as the one shown in FIG. 6 in that a pump 80 is used for a fuel supply pump, and that fuel is supplied to a delivery pump chamber 517 through an annular groove 29 of a timing valve 27, a timing passage 170, and a timing port 121. In this embodiment, the spill lead 143 and the annular groove 148 of the injection plunger 140 and the spill port 142 of the injection cylinder 111 in the embodiment of FIG. 6 are eliminated. A drain port 144 of the injection cylinder 111 communicates with a timing spring chamber 401 in the timing valve 27 through a drain passage 400. The timing spring chamber 401 communicates with a feed passage 301 through a communication passage 403 having a restrictor 402 provided therein. A timing drain valve 404 is provided between the feed passage 301 and an pressure passage 178, and a timing check valve 405 is disposed in the pressure passage 178. The timing port 121 is so located as not to be closed even when a timing lead 522 reaches its bottom dead center. For example, the time port 121 is opened to the pump chamber 517 at its bottom.

In the apparatus of this construction, the pressure of fuel transmitted from the pressure passage 178 to a pressure intake chamber 41 of the timing valve 27 moves the timing valve body 27*a* to close a spill port 175. Then, fuel in the delivery pump chamber 517 is pressurized as the delivery plunger 516 is lowered. Even after the period for the fuel delivery to the pressure passage 178 ends, however, the fuel pressure in the pressure intake chamber 41 is maintained by the timing check valve 405 in the pressure passage 178 so that the timing valve 27 is prevented from returning.

When the fuel in the delivery pump chamber 517 is pressurized, it pushed the injection plunger 140. As the injection plunger 140 is lowered, the fuel in an injection pump chamber 141 is pressed to be sprayed out of the nozzle hole 46 of an injection nozzle 36 through the passage 152. The injection ends when a drain lead 145 of the injection plunger 140 opens the drain port 144, and the fuel in the delivery pump chamber 517 is fed into the timing spring chamber 401 through the drain passage 400. Accordingly, the fuel pressure the timing spring chamber 401 is raised to return the timing valve body 27*a* in cooperation with a spring 28. At the same time, the fuel in the pressure intake chamber 41 is returned to the feed passage 301 through the timing drain valve 404. The valve opening pressure of the timing drain valve 404 is higher than those of a metering valve 161 and the timing check valve 405. When the annular groove 29 of the timing valve 27 is alinged with the spill port 175, the fuel in the delivery pump chamber 517 is returned from the timing port 121 to the feed passage 301. Thus, cut-off of injection is carried out very sharply.

This invention is not limited to the aforementioned embodiments, and various changes and modifications may be effected therein by one skilled in the art without departing from the scope or spirit of the invention.

For example, a fuel gallery may be provided in the return passage 51 shown in FIG. 4 so that a fixed pressure is maintained by an overflow valve set in the gallery. Thus, fuel can be fed back from the drain port 144 to the delivery pump chamber 517 to relieve the load on the pump 50. The outlet port 523 and spill port 142 are not required.

What we claim is:

1. A fuel injection apparatus for an internal combustion engine comprising:

(a) a fuel tank;

(b) a fuel injection unit mounted on an internal combustion engine for injecting fuel into a combustion chamber of said engine, said fuel injection unit having, (i) a cylinder, (ii) a driving plunger reciprocally held in said cylinder to form a pump chamber for receiving fuel from said fuel tank, said driving plunger being driven by said engine, (iii) a timing port formed in said cylinder and opening to said pump chamber, (iv) a nozzle holder communicated with said pump chamber;

(c) a fuel control pump operated by said engine for feeding out a fuel through an output port thereof, the amount of said fuel and the timing of feeding out said fuel responding to operational conditions of said engine;

(d) a timing passage communicating said pump chamber of said fuel injection unit with said fuel tank; and (e) a control valve disposed in said timing passage for opening and closing said timing passage, said control valve having, (i) a control chamber, (ii) a control valve body reciprocally disposed in said control chamber, (iii) a spring for biasing said control valve body in a direction of opening said timing passage, and (iv) a timing chamber connected to said output port of said fuel control pump for driving said control valve body in a direction of closing said timing passage so long as the fuel from said fuel control pump is supplied into said timing chamber, whereby the timing of fuel injection and the amount of the fuel injected through said fuel injection unit are controlled by said fuel control pump.

2. A fuel injection apparatus for an internal combustion engine comprising:

(a) a fuel tank;

(b) a fuel injection unit mounted on an internal combustion engine for injecting fuel into a combustion chamber of said engine, said fuel injection unit having, (i) a cylinder, (ii) a driving plunger reciprocally held in said cylinder to form a pump chamber, said driving plunger being driven by said engine, (iii) a timing port formed in said cylinder and opening to said pump chamber, (iv) a supply port formed in said cylinder and opening to said pump chamber for supplying fuel from said fuel tank into said pump chamber, and (v) a nozzle holder communicated with said pump chamber;

(c) a fuel control pump operated by said engine for feeding out a fuel through an output port thereof, the amount of said fuel and the timing of feeding out said fuel being responsive to operational conditions of said engine;

(d) a timing passage communicating said pump chamber of said fuel injection unit with said fuel tank; and (e) a control valve disposed in said timing passage for opening and closing said timing passage, said control valve having, (i) a control chamber, (ii) a control valve body reciprocally disposed in said control chamber, (iii) a spring for biasing said control valve body in a direction of opening said timing passage, and (iv) a timing chamber connected to said output port of said fuel control pump for driving said control valve body in a direction of closing said timing passage so long as the fuel from said fuel control pump is supplied into said timing chamber, whereby the timing of fuel injection and the amount of the fuel injected through said fuel injection unit are controlled by said fuel control pump.

3. A fuel injection apparatus for an internal combustion engine comprising:

(a) a fuel tank;

(b) a fuel injection unit mounted on an internal combustion engine for injecting fuel into a combustion chamber of said engine, said fuel injection unit having, (i) a cylinder, (ii) a driving plunger reciprocally held in said cylinder to form a pump chamber, said driving plunger being driven by said engine, (iii) a timing port formed in said cylinder and opening to said pump chamber, (iv) a supply port formed in said cylinder and opening to said pump chamber for supplying fuel from said fuel tank into said pump chamber, and (v) a nozzle holder communicated to said pump chamber for injecting fuel into said combustion chamber when a fuel under pressure is supplied into said nozzle holder;

(c) a fuel control pump operated by said engine for feeding out a fuel through an output port thereof, the amount of said fuel and the timing of feeding out said fuel being responsive to operational conditions of said engine;

(d) a timing passage communicating said pump chamber of said fuel injection unit with said fuel tank; and (e) a control valve disposed in said timing passage for opening and closing said timing passage, said control valve having, (i) a control chamber, (ii) a control valve body reciprocally disposed in said control chamber, (iii) a spring for biasing said control valve body in a direction of opening said timing passage, and (iv) a timing chamber connected to said output port of said fuel control pump for driving said control valve body in a direction of closing said timing passage so long as the fuel from said fuel control pump is supplied into said timing chamber, whereby the timing of fuel injection by said fuel injection unit is controlled by said fuel control pump.

4. A fuel injection apparatus for an internal combustion engine having engine cylinders, comprising:

(a) a fuel tank;

(b) fuel delivery means connected with said fuel tank for delivering fuel from said fuel tank;

(c) fuel injection units each mounted on a corresponding one of said engine cylinders and including:

(i) cylinder means including a first cylinder and a second cylinder arranged in tandem;

(ii) plunger means including a fuel delivery plunger inserted in said first cylinder and reciprocated by said engine and an injection plunger inserted in said second cylinder;

(iii) pump chamber means including a first pump chamber defined by said first cylinder and one end of said fuel delivery plunger which is close to said second cylinder, a pressure chamber defined by said second cylinder and one end of said injection plunger which is close to said first cylinder, said pressure chamber communicating with said first pump chamber, and a second pump chamber defined by said second cylinder and the other end of said injection plunger;

(iv) an injection nozzle operatively connected with said second pump chamber for injecting fuel into said engine cylinder while fuel under pressure is supplied from said pump chamber means to said injection nozzle, and (v) a timing port formed in said first cylinder and opening to said first pump chamber;

(d) a timing passage for allowing fuel in said pump chamber means to drain when said timing port is connected with said timing passage;

(e) a control valve connected with said timing passage for opening and closing said timing passage and including:

(i) a control chamber;

(ii) a control valve body disposed in said control chamber and movable between an open position in which said timing passage is opened and a closed position in which said timing passage is closed, whereby fuel injection from said injection nozzle is controlled, (iii) urging means for normally urging said control valve body to be disposed in said open position, and (iv) a timing chamber formed adjacent said control valve body in said control chamber for receiving fuel to move said control valve body to said closed position against said urging means; and (f) a fuel control pump having as many output ports as said engine cylinders and wherein each of said output ports communicates with said second pump chamber of a corresponding one of said fuel injection units and with the timing chamber of the control valve of the fuel injection unit which is adjacent to said one of said fuel injection units and with the engine cylinder with which said adjacent fuel injection unit it connected, whereby, when fuel is delivered from said fuel control pump through said output ports the fuel is supplied to said second pump chamber of said one of said fuel injection units and the timing chamber of the control valve of said adjacent fuel injection unit to close the timing passage of said adjacent fuel injection unit; and said fuel injection unit also comprises a metering port formed in said second cylinder and communicating with said second pump chamber, and a drain port formed in said second cylinder and opening to said pressure chamber when said injection plunger is moved toward said pressure chamber, for a predetermined length to drain fuel in said first pump chamber through said drain port.

5. The apparatus according to claim 4, wherein said fuel delivery means comprises a fuel supply pump connected with said fuel control pump and said timing passage.

6. The apparatus according to claim 5, further comprising a surge tank connected with said fuel supply pump and said timing passage.

7. The apparatus according to claim 6, further comprising a pressure regulating valve connected with said fuel control pump for regulating fuel pressure generated by said fuel supply pump.

8. The apparatus according to claim 7, further comprising a cut-off solenoid valve connected with said fuel control pump and said surge tank.

9. A fuel injection apparatus for an internal combustion engine comprising:

(a) a fuel tank;

(b) first and second fuel injection units mounted on an internal combustion engine for injecting fuel into respective combustion chambers of said engine, each of said fuel injection units having, (i) first and second cylinders, (ii) a driving plunger reciprocally held in said first cylinder to form a first pump chamber, said driving plunger being driven by and in synchronism with said engine, (iii) a timing port formed in said first cylinder and opening to said first pump chamber, (iv) a supply port formed in said first cylinder and opening to said first pump chamber, (v) an injection plunger reciprocally held in said second cylinder to form a pressure chamber at one side thereof and a second pump chamber at the other side thereof, said pressure chamber being communicated with said first pump chamber, (vi) a metering port formed in said second cylinder and opening to said second pump chamber, (vii) a drain port formed in said second cylinder and opening to said pressure chamber when said injection plunger is moved toward said second pump chamber by a certain stroke, whereby fuel in said pressure chamber is drained through said drain port, and (viii) a nozzle holder communicated with said second pump chamber for injecting fuel into said combustion chamber when fuel under pressure is supplied into said nozzle holder from said second pump chamber;

(c) a fuel control pump operated by said engine and having first and second output ports for feeding out fuel through said first and second output ports alternately;

(d) first and second timing passages respectively communicating said first pump chambers of said first and second fuel injection units with said fuel tank;

(e) first and second control valves respectively disposed in said first and second timing passages for respectively opening and closing said timing passages, each of said first and second control valves having, (i) a control chamber, (ii) a control valve body reciprocally disposed in said control chamber, (iii) a spring for biasing said control valve body in a direction of opening said timing passage, and (iv) a timing chamber for driving said control valve body in a direction of closing said timing passage when fuel from said fuel control pump is supplied into said timing chamber;

(f) said first output port of said fuel control pump being communicated with both of said second pump chamber of said first fuel injectioh unit and said timing chamber of said second control valve, whereby when the fuel is fed out through said first output port, the fuel is supplied into said second pump chamber of said first fuel injection unit and said control valve body of said second control valve is driven to close said second timing passage; and (g) said second output port of said fuel control pump being communicated with both of said second pump chamber of said second fuel injection unit and said timing chamber of said first control valve, whereby when the fuel is fed out through said second output port, the fuel is supplied into said second pump chamber of said second fuel injection unit and said control valve body of said first control valve is driven to close said first timing passage, whereby the timing of fuel injection and the amount of the fuel injected through said first and second fuel injection units are controlled by said fuel control pump.

10. The apparatus according to claim 9, wherein said fuel delivery means comprises a first fuel supply pump connected with said first pump chamber and said fuel tank, and a second fuel supply pump connected with said control valve and said fuel tank.

11. The apparatus according to claim 10, further comprising pressure regulating valves connected to said first and second fuel supply pumps, respectively, for regulating fuel pressures generated by said first and second fuel supply pumps.

12. The apparatus according to claim 11, further comprising a cut-off solenoid valve connected with said second fuel supply pump and said fuel control pump.

* * * * *